US006267041B1

(12) United States Patent
Skiba et al.

(10) Patent No.: US 6,267,041 B1
(45) Date of Patent: Jul. 31, 2001

(54) FLUID REGENERATION CIRCUIT FOR HYDRAULIC CYLINDERS

(75) Inventors: Richard J. Skiba; Vijay P. Shah, both of Peoria; Kenneth L. Stratton, Dunlap, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/464,498

(22) Filed: Dec. 15, 1999

(51) Int. Cl.[7] ..... F15B 11/08
(52) U.S. Cl. ..... 91/436; 91/440
(58) Field of Search ..... 91/436, 440

(56) References Cited

U.S. PATENT DOCUMENTS

| | | | | |
|---|---|---|---|---|
| 2,935,852 | * | 5/1960 | Russell | 91/440 X |
| 3,071,926 | * | 1/1963 | Olson et al. | 91/436 X |
| 3,965,587 | * | 6/1976 | Johns, Jr. | 91/436 X |
| 4,152,970 | * | 5/1979 | Hall et al. | 91/436 X |
| 4,359,931 | * | 11/1982 | Palmersheim et al. | 91/436 |
| 4,913,616 | | 4/1990 | Dunn . | |
| 4,955,282 | * | 9/1990 | Ranson | 91/436 |
| 5,220,862 | | 6/1993 | Schexnayder | 91/436 |
| 5,226,348 | * | 7/1993 | Dezelan et al. | 91/436 |
| 5,251,705 | * | 10/1993 | Waggoner et al. | 91/436 X |
| 5,370,038 | * | 12/1994 | Poppe et al. | 91/436 |
| 5,415,076 | * | 5/1995 | Krone et al. | 91/436 X |
| 5,682,955 | | 11/1997 | Groth et al. . | |
| 5,737,993 | | 4/1998 | Cobo et al. . | |
| 5,791,226 | | 8/1998 | Chung et al. . | |
| 5,907,991 | * | 6/1999 | Ramamoorthy et al. | 91/436 |

* cited by examiner

*Primary Examiner*—John E. Ryznic
(74) *Attorney, Agent, or Firm*—W. Bryan McPherson, III

(57) ABSTRACT

A fluid regeneration circuit for a hydraulic system having at least one hydraulic actuating cylinder associated therewith, the present circuit including a control valve connected in fluid communication with the actuating cylinder for controlling the operation thereof, a regeneration valve connected in fluid communication with the control valve and with the head and rod end portions of the cylinder, a position sensor coupled to the actuating cylinder for sensing the position of the piston within the cylinder during movement thereof, and a controller coupled to the position sensor, the control valve and the regeneration valve for controlling fluid flow to and from the actuating cylinder. The controller is operable to receive signals from the position sensor and determine the velocity of the piston based upon the signals outputted by the position sensor, and it is operable to output appropriate signals to the regeneration valve to regenerate fluid flow to the head end portion of the actuating cylinder when the velocity of the piston is determined to be above a first predetermined threshold velocity, and to discontinue fluid flow to the head end portion of the actuating cylinder when the velocity of the piston is below a second predetermined threshold velocity.

25 Claims, 2 Drawing Sheets

FLUID REGENERATION CIRCUIT FOR HYDRAULIC CYLINDERS

TECHNICAL FIELD

This invention relates generally to hydraulic control systems used in work machines and, more particularly, to a hydraulic regeneration circuit for improving the response time and performance of a hydraulic system.

BACKGROUND ART

Construction and earthmoving equipment as well as a wide variety of other types of work machines are commonly used in a wide variety of different types of construction and earthmoving applications. These work machines typically include a wide variety of hydraulically actuated implements and/or work attachments such as buckets, front shovels, scrapers and the like which are utilized in different applications to accomplish different tasks. The control and operation of these various implements and/or work attachments preferably have a be timely response to the operator input commands controlling the operation thereof without sacrificing performance or power.

Sometimes a delay in implement or work attachment responsiveness may occur during a particular work application due to the fact that the hydraulic pump servicing the operation of the particular implement cannot provide the necessary amount of fluid flow to the implement actuator means as requested by the operator. For example, this may occur when an implement such as a blade on a track type tractor is rapidly lowered to the ground and the operator input is thereafter immediately actuated to lower the blade into the ground. For example, if the blade is raised above the ground line, then lowered, the blade will rapidly lower to the ground due to gravity. The rapid lowering movement will cause the cylinder to void. Further lowering of the blade is delayed until the pump fills the void in the cylinder. The delay typically occurs because during this rapid movement the hydraulic pump servicing the particular hydraulic circuit will be providing a large amount of fluid to the actuating means controlling the movement and operation of the implement or work attachment. Where the implement actuating means is a hydraulic cylinder, the hydraulic pump will provide fluid flow to either the head end portion or the rod end portion of the hydraulic cylinder to control the extension or retraction thereof. When fluid flow is provided to the rod end portion of the cylinder thereby retracting the same, fluid present in the head end portion is contracted and allowed to exit therefrom under pressure and escape to other portions of the circuit In the example where a blade associated with a track type tractor is rapidly lowered at low pressure, the hydraulic pump will be providing a large amount of fluid to the head end portion of the actuating cylinder. When the cylinder is then requested to move immediately in the same direction at high pressure, the hydraulic pump is unable to provide enough fluid flow to the head end portion of the cylinder in order to meet the responsiveness desired by the operator. In other words, the head end portion of the actuating cylinder is not refilled, or regenerated, fast enough to achieve the desired responsiveness.

Although some hydraulic control systems employ a regeneration circuit to fill the expanding side of a hydraulic cylinder or other actuator means with fluid exhausted from the contracting side, it would be desirable to provide a regeneration circuit which would be more responsive to certain parameters which are indicative of the operator requesting a rapid movement of the actuator means associated with a particular implement or work attachment. In this regard, it would also be desirable to provide a regeneration circuit which will increase the efficiency of filing the expanding side of a hydraulic actuating cylinder.

Accordingly, the present invention is directed to overcoming one or more of the problems as set forth above.

DISCLOSURE OF THE INVENTION

In one aspect of the present invention, a fluid regeneration circuit is provided for a hydraulic system utilizing a hydraulic actuating cylinder for controlling the movement of an implement or other work attachment, the present regeneration circuit being specifically triggered for expanding the head end portion of the actuating cylinder based upon the velocity or rate of movement of the piston associated with the cylinder. More particularly, the present regeneration circuit includes an electrohydraulic regeneration or diverter valve positioned in fluid communication with the rod end portion of the actuating cylinder and actuatable so as to divert fluid flow from the rod end portion of the actuating cylinder to the head end portion thereof when so commanded. A position sensor is coupled to the actuating cylinder for monitoring the position of the piston within the actuating cylinder, the position sensor being coupled to an electronic controller which is operable to monitor the rate of movement or velocity of the piston within the actuating cylinder.

The electronic controller is likewise coupled to the diverter valve such that if the velocity of the cylinder piston exceeds a predetermined velocity, the controller will output an appropriate signal to the diverter valve actuating such valve so as to divert fluid from the rod end portion to the head end portion of the actuating cylinder thereby filling the head end portion of the cylinder faster so as to provide better responsiveness to the operator input commands controlling the operation of the implement. The diverter valve will continue to divert fluid to the head end portion of the actuating cylinder until the velocity of the cylinder piston drops to another predetermined velocity. At this point, the controller will output an appropriate signal to the diverter valve discontinuing regeneration of the actuating cylinder and returning the diverter valve to its normal position wherein fluid flow from the rod end portion of the cylinder is allowed to flow to other portions of the hydraulic system. Accordingly, the present regeneration or diverter valve functions to regenerate the head end portion of the actuating cylinder based solely upon the rate of movement or velocity of the cylinder piston.

The present diverter valve can be either a proportional valve or an on/off type valve, the proportional valve arrangement allowing proportional regeneration to the head end portion of the actuating cylinder based upon the velocity of the cylinder piston. A wide variety of different types of diverter valves as well as a wide variety of different types of position sensors can be utilized with the present invention. Also, velocity sensors specifically designed to output a signal indicative of the velocity of the cylinder piston can likewise be utilized in place of a position sensor.

The present fluid regeneration circuit is therefore specifically responsive to the rapid movement of the implement actuating cylinder based upon the cylinder piston velocity parameter and such regeneration circuit can be utilized in a wide variety of different types of work machines as well as a wide variety of different hydraulic circuit applications The present regeneration circuit provides a more responsive regeneration capability and increases the overall efficiency of filling the expanding side of a actuating hydraulic cylinder.

BRIEF DESCRIPTION OF THE DRAWINGS

For a better understanding of the present invention, reference may be made to the accompanying drawings in which the sole FIGURE is a schematic illustration of an embodiment of the present invention.

BEST MODE FOR CARRYING OUT THE INVENTION

Figure 1:
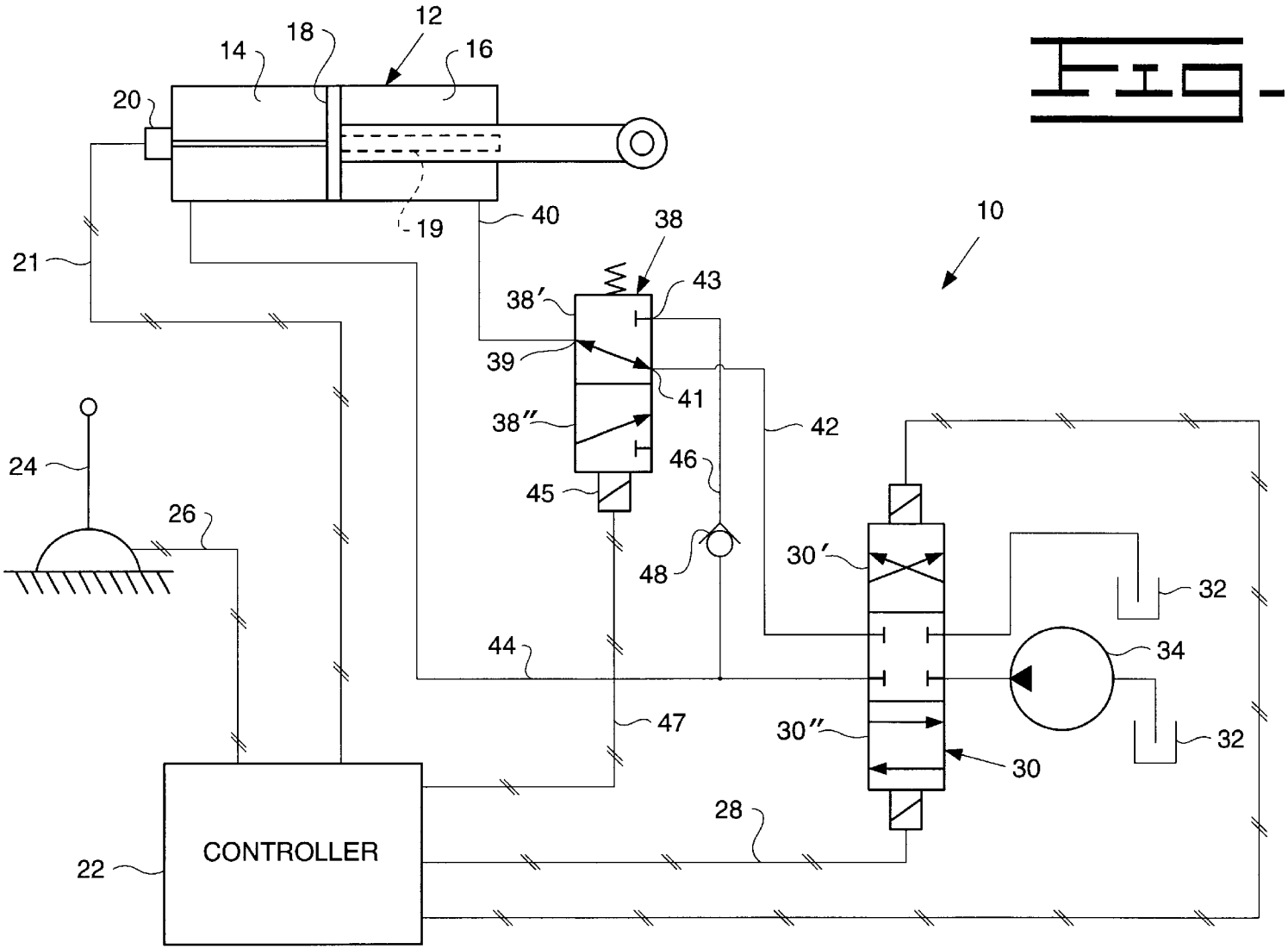

Referring to FIG. 1, a hydraulic system regeneration circuit 10 is depicted in one embodiment of the present invention and includes a hydraulic actuating cylinder 12 connected in fluid communication with a conventional control valve 30 for controlling the operation thereof. Hydraulic cylinder 12 includes a head end portion 14, a rod end portion 16, and a movable piston 18 located therein. The cylinder 12 may be connected in a conventional manner to any appropriate implement or work attachment associated with a particular work machine. The cylinder 12 will extend and retract to control movement of the associated implement.

A position sensor 20 is coupled to the cylinder 12 so as to sense the position of the piston 18 within the cylinder 12 as the piston moves axially therewithin. Position sensors such as sensor 20 are well known in the industry and may include a variety of known linear sensor and resolvers as well as various encoding systems which utilize both incremental codes and absolute codes for determining the piston of a wide variety of elements along a path of movement. Such codes or other markings may be etched onto a rod such as rod 19 for sensing by sensor 20 as the piston 18 moves axially therealong. In an alternative embodiment, a velocity sensor may be used to sense a parameter indicative of the velocity of the piston.

Position sensor 20 is operatively coupled to an electronic control module (ECM) or other controller or processor 22 via conductive path 21 and outputs a signal to ECM 22 indicative of the position of piston 18 within cylinder 12. Electronic controllers or modules such as ECM 22 are commonly used in association with work machines for controlling and accomplishing various tasks including monitoring and controlling a wide variety of mechanical functions such as engine speed and fluid flow. Such controllers are typically utilized for delivering current control signals to devices such as valves and pumps for controlling fluid flow. Those skilled in the art are familiar with implementing programs and methods in electronic control modules such as ECM 22 to accomplish particular tasks such as those discussed herein. In this regard, controller or ECM 22 may include processing means such as a microcontroller or microprocessor, associated electronic circuitry such as input/output circuitry, analog circuits or programmed logic arrays, as well as associated memory. Controller or ECM 22 can therefore be programmed to sense and recognize appropriate signals from position sensor 20 indicative of the relative position of piston 18 within cylinder 12 and, based upon such sensed piston positions, controller or ECM 22 can determine the rate of movement or velocity of piston 18 as will be hereinafter further explained.

Hydraulic cylinder 12 may be one of a number of hydraulic cylinders typically implemented in a particular work machine to control the movement of a particular implement as well as movement of the various mechanical components associated therewith such as the swing motion of a bucket or raising and lowering of the boom and stick connected to the bucket. The operator of the work machine controls the operation and movement of such mechanical components and the implement itself through the use of an operator control mechanism 24 such as one or more control levers, joysticks or other operator input devices known in the art. Movement of the operator input device 24 outputs appropriate signals to ECM 22 via conductive path 26 to control the operation of the implement. In this regard, ECM 22 will output appropriate signals to control valve 30 via conductive path 28 as will be hereinafter explained.

As illustrated in FIG. 1, control valve 30 is shown as being a conventional three position hydraulic valve well known to those skilled in the art. Depending upon the desired movement of piston 18 within cylinder 12, ECM 22 will output a signal to control valve 30 via conductive path 28 so as to move valve 30 into either a first operating position 30' or a second operating position 30". When valve 30 is moved to position 30', hydraulic fluid from the head end portion 14 of cylinder 12 will be allowed to exit or exhaust to tank 32 for use elsewhere in the system, while hydraulic pump 34 will supply hydraulic fluid under pressure through valve 38 as will be hereinafter explained to the rod end portion 16 of cylinder 12 thereby expanding the rod end portion and causing piston 18 to move towards head end portion 14. In contrast, when valve 30 is moved to position 30", hydraulic fluid from the rod end portion 16 is allowed to exhaust through valve 38 to tank 32, while pump 34 will supply hydraulic fluid under pressure directly to the head end portion 14 of cylinder 12 thereby expanding the head end portion and causing piston 18 to move towards rod end portion 16.

The present regeneration circuit also includes a flow-control regeneration or diverter valve 38 which is positioned in fluid communication between the actuating cylinder 12 and the control valve 30 as shown in FIG. 1. Regeneration valve 38 is depicted as being a two position valve having its inlet port 39 connected in fluid communication with the rod end portion 16 of cylinder 12 via fluid path 40, having its outlet port 41 connected in fluid communication with control valve 30 via fluid path 42, and having its outlet port 43 connected in fluid communication with fluid path 44 via fluid path 46. Fluid path 44 extends between control valve 30 and the head end portion 14 of cylinder 12 for providing fluid flow thereto via pump 34.

Regeneration valve 38 also includes a solenoid or other electrical actuating means 45 which is coupled to ECM 22 via conductive path 47. At the appropriate time, ECM 22 will output an appropriate signal to regeneration valve 38 so as to move valve 38 from its normally biased position 38' which allows normal fluid flow through valve 38 to and from the rod end portion 16 of cylinder 12 to its regeneration position 38". When valve 38 is moved to its regeneration position 38", hydraulic fluid exiting the rod end portion 16 of cylinder 12 via fluid path 40 will be directed via fluid path 46 through a one way check valve 48 to fluid conduit 44. It can be appreciated that when regeneration valve 38 is moved to its regeneration position 38", control valve 30 will have already been moved to its operating position 30" wherein fluid flow from pump 34 is already being provided to the head end portion 14 of cylinder 12. As a result, the diverted fluid flow from the rod end portion 16 through regeneration valve 38 to fluid path 44 via fluid path 46 will join fluid already being directed to head end portion 14 thereby increasing such fluid flow and regenerating the head end portion 14 of cylinder 12.

In one embodiment of the present invention, regeneration valve 38 includes an on/off solenoid 45 wherein valve 38 will be either fully opened or fully closed in one of its two operating positions, namely, non-regeneration position 38' and regeneration position 38". The determination regarding placing the valve 38 in the regeneration position 38" is based upon the velocity of the cylinder piston 18. In another embodiment of the present invention, regeneration valve 38 includes a proportional solenoid 45 wherein regeneration of the head portion 14 of cylinder 12 can take place incrementally based upon the particular velocity of the cylinder piston 18. In this particular situation, a first predetermined threshold velocity may trigger partial fluid flow through regeneration valve 38 to the head end portion 14 of cylinder 12 whereas a second predetermined threshold velocity may trigger maximum fluid flow through regeneration valve 38. Piston velocities between the first and second predetermined minimum and maximum velocities would accordingly trigger a proportional fluid flow through regeneration valve 38 in accordance with a regeneration schedule or map stored within the memory of ECM 22. Other variations and modifications to the regeneration schedule when a proportional solenoid is used are likewise possible.

In one embodiment, the triggering of regeneration valve 38 is based upon the rate of movement or velocity of piston 18 within cylinder 12. During operation, sensor 20 preferably continuously monitors the position of piston 18 and provides this information to ECM 22 via an electrical signal outputted via conductive path 21. Based upon the relative position of piston 18 within cylinder 12 as it moves axially therewithin in one or both directions, ECM 22 can therefore calculate the velocity of piston 18 by determining the rate of change of the position of piston 18 within cylinder 12. If the velocity of piston 18 while moving from head end portion 14 towards rod end portion 16 exceeds a first predetermined threshold velocity, and the signal from joystick 24 to ECM 22 indicates a continuing request by the operator to extend cylinder 12, ECM 22 will output a signal to regeneration valve 38 to move the valve to operating position 38" thereby starting regeneration as explained.

Figure 2:
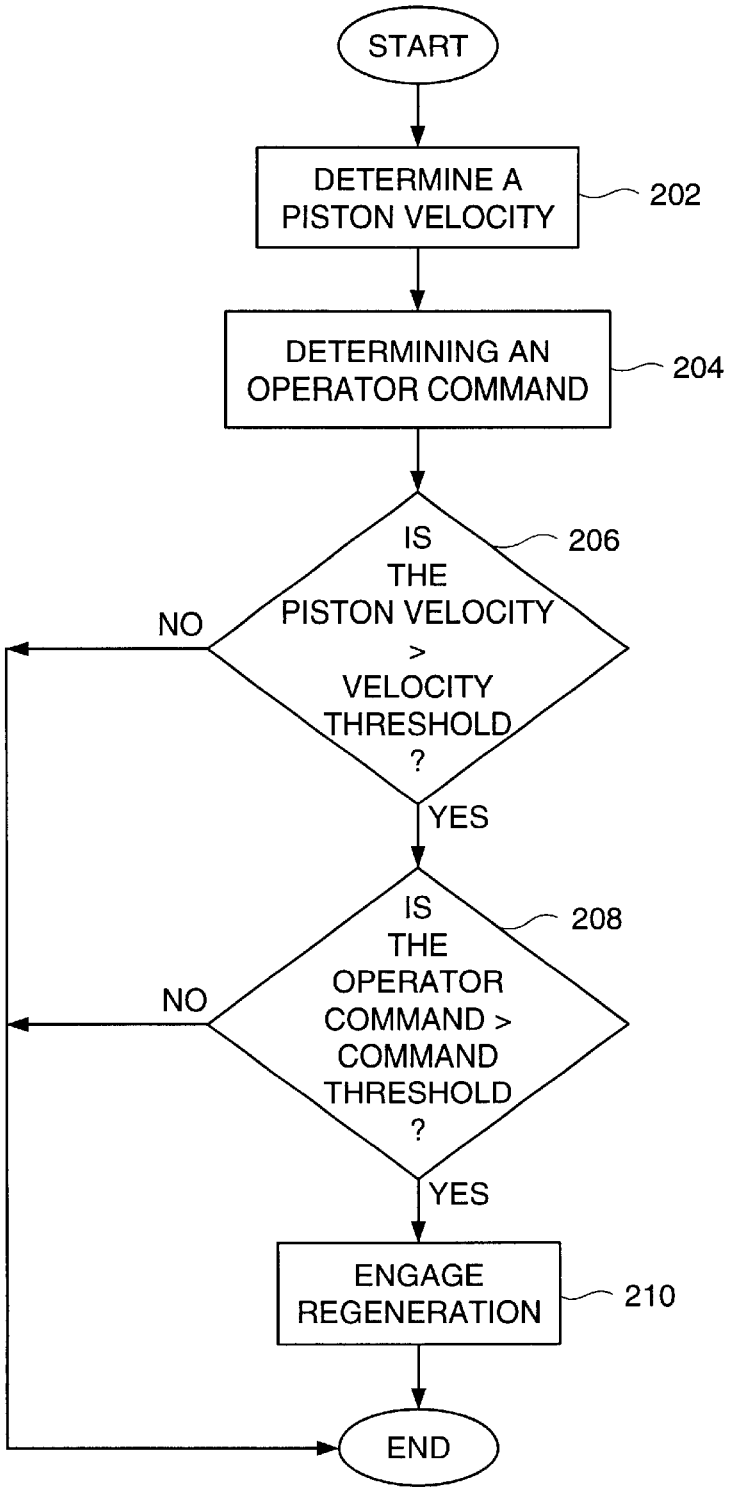

In an alternative embodiment, the triggering of the regeneration valve 38 is based upon the rate of movement, or velocity, of the piston 18 within the cylinder 12, and the position of the operator input device 24, e.g., joystick or blade control handle. For example, FIG. 2 illustrates one embodiment of the present invention. In a first control block 202 a piston velocity is determined. The piston velocity may be determined in response to the position sensor signal, or a velocity sensor signal if available. In a second control block 204, an operator command is determined. For example, the signal generated by the operator command device 24 is indicative of an desired operator command. In one embodiment the signal is indicative of the position of the operator input device 24, wherein the device position is indicative of the desired operator command. The triggering of the regeneration valve 38 is performed in response to the piston velocity and the joystick position. For example, in a first decision block 206, the velocity is compared to a velocity threshold. If the velocity does not exceed the velocity threshold then regeneration is not triggered and control returns to the beginning of the method. If the velocity threshold is exceeded, then in a second decision block 208, the desired operator command, or device position is compared with a command threshold, or position threshold respectively. If, for example, the actual device position does not exceed the position threshold, e.g., 75% of joystick travel in a specified direction, then regeneration is not triggered, and control returns to the beginning of the method. If the desired command, or position does exceed the command threshold, or position threshold respectively, then control proceeds to a fifth control block 210, and regeneration is engaged. Regeneration is engaged as described above. In one embodiment, the amount the regeneration valve 38 is moved is based upon either the magnitude of the piston velocity, the joystick position, or a combination thereof. Once regeneration has been triggered, when the piston velocity drops below a second velocity threshold, regeneration may be discontinued. In an alternative embodiment, regeneration may be discontinued in response to the desired command, or joystick position, dropping below a second command threshold, or position threshold respectively, or a combination of the piston velocity and joystick position dropping below respective thresholds.

The additional hydraulic fluid add to flow path 44 from regeneration valve 38 adds to the fluid already being delivered to head end portion 14 thereby improving the performance and response time of piston 18. If valve 38 is a proportional valve, the amount of hydraulic fluid regenerated to head end portion 14 of cylinder 12 may correspond directly to the velocity of piston 18 as previously explained. In this situation, the response of piston 18 moving within cylinder 12 will be maintained at an optimal level for all piston speeds. When the velocity of piston 18 drops below a second predetermined threshold velocity, ECM 22 will output an appropriate signal to regeneration valve 38 to return to its previous biased position 38' and discontinue regeneration. Although the present regeneration circuit has been described specifically with reference to a hydraulic actuating cylinder, it is recognized and anticipated that the present regeneration circuit can likewise be adapted for use with other actuating means.

Industrial Applicability

As described herein, the present regeneration circuit has particular utility in all types of work machines and other vehicles wherein hydraulic cylinders and other actuating means are utilized to control the operation of implements, work attachments, or other mechanical components. In this regard, it will be appreciated by those skilled in the art that the specific construction, configuration and type of valves utilized for control valve 30 and regeneration valve 38 may vary depending upon the particular work machine and the particular implement and/or other application involved without departing from the sprit and scope of the present invention.

The system disclosed herein may also be used to regenerate a plurality of hydraulic cylinders or other actuator means associated with a particular hydraulic system. In one embodiment of a multiple hydraulic cylinder regeneration system, fluid flow paths from the respective rod end portions of each cylinder may all be fed into a combiner type device in order to combine these separate fluid flows into one flow path existing the combiner device to the regeneration valve. In similar fashion, a divider type device may be positioned in the regeneration fluid path so that respective flow paths existing the divider device may be routed to the head end portion of each respective cylinder. Accordingly, any of the plurality of cylinders may be regenerated in accordance with the teachings of the present invention.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawing, the disclosure and the appended claims.

What is claimed is:

1. A fluid regeneration circuit for a hydraulic system having at least one hydraulic actuating cylinder associated therewith, said actuating cylinder having a head end portion, a rod end portion, and a piston movable therewithin, the regeneration circuit comprising:

a regeneration valve connected in fluid communication with the head and rod end portions of the actuating cylinder, said regeneration valve having an inlet port connected in fluid communication with the rod end portion of the actuating cylinder via a first fluid path, said regeneration valve having a first outlet port connected in fluid communication with the hydraulic system via a second fluid path, said regeneration valve having a second outlet port connected in fluid communication with the head end portion of the actuating cylinder via a third fluid path;

a position sensor coupled to the actuating cylinder for determining the position of the piston within the actuating cylinder; and a controller coupled to said position sensor for receiving signals therefrom, said controller being operable to receive signals from said position sensor indicative of the position of the piston within the actuating cylinder during movement thereof, said controller being further operable to determine the velocity of said piston based upon the signal outputted by said position sensor;

said controller being coupled to said regeneration valve and being operable to output signals thereto in response to the signals received from said position sensor, said controller outputting a signal to said regeneration valve to allow fluid flow from said regeneration valve through said third fluid path to the head end portion of the actuating cylinder when the velocity of the piston is determined to be above a first predetermined threshold velocity, said controller outputting a signal to the regeneration valve to allow fluid flow from said regeneration valve through said second fluid path when said controller determines that the velocity of the piston is below a second predetermined threshold velocity.

2. The fluid regeneration circuit as set forth in claim 1 including a check valve positioned in fluid communication with said third fluid path, said check valve substantially limiting the fluid flow in said third fluid path from flowing back to said regeneration valve.

3. The fluid regeneration circuit as set forth in claim 1 wherein said regeneration valve is a two position valve, one position of said valve allowing substantially all of the fluid flow from the rod end portion of the actuating cylinder to flow into said second fluid path, and the other position of said regeneration valve allowing substantially all of the fluid flow from the rod end portion of the actuating cylinder to flow into said third fluid path.

4. The fluid regeneration circuit as set forth in claim 1 wherein said regeneration valve is a proportional valve, and wherein the signal outputted by said controller to said regeneration valve to allow fluid flow to the head end portion of the actuating cylinder will allow partial fluid flow thereto via said third fluid path when the velocity of the piston is between a third and fourth predetermined threshold velocity.

5. The fluid regeneration circuit as set forth in claim 4 wherein the amount of said partial fluid flow from the regeneration valve to the head end portion of the actuating cylinder is based upon the specific velocity of the piston between said third and fourth predetermined threshold velocities, said fluid flow being proportional thereto.

6. The fluid regeneration circuit as set forth in claim 1 wherein said second and third fluid paths are connected in fluid communication with a control valve, said control valve being operable to control fluid flow to the head and rod end portions of the actuating cylinder, said controller being coupled to said control valve for outputting a signal thereto to control fluid flow to the actuating cylinder.

7. A fluid regeneration circuit for a hydraulic system having a hydraulic actuating cylinder, the actuating cylinder having a head end portion, a rod end portion, and a piston movable therewithin, the regeneration circuit comprising:

a control valve connected in fluid communication with the head and rod end portions of the actuating cylinder for controlling the operation thereof;

a regeneration valve connected in fluid communication with said control valve and with the head and rod end portions of the actuating cylinder, said regeneration valve being operable in one position thereof to allow fluid flow to flow therethrough from the rod end portion of the actuating cylinder to said control valve for distribution to other portions of the hydraulic system, said regeneration valve being operable in another position to allow fluid flow therethrough from the rod end portion of the actuating cylinder to the head end portion of the actuating cylinder;

a position sensor coupled to the actuating cylinder for sensing the position of the piston within the actuating cylinder during movement thereof and generating a signal indicative of said position;

a controller coupled to said position sensor for receiving signals therefrom, said controller being operable to receive signals from said position sensor and thereafter determine the velocity of said piston based upon the signals outputted by said position sensor;

said controller being coupled to said control valve and being operable to output signals thereto for controlling fluid flow to and from the respective head and rod end portions of the actuating cylinder;

said controller being further coupled to said regeneration valve and being operable to output signals thereto in response to the signals received from said position sensor, said controller outputting a signal to said regeneration valve to allow fluid flow from the rod end portion of the actuating cylinder through said regeneration valve to the head end portion of the actuating cylinder when the velocity of the piston is determined to be above a first predetermined threshold velocity, said controller outputting a signal to the regeneration valve to allow fluid flow from the rod end portion of the actuating cylinder through said regeneration valve to said control valve when said controller determines that the velocity of said piston is below a second predetermined threshold velocity.

8. The fluid regeneration circuit as set forth in claim 7 wherein said regeneration valve is a proportional valve, and wherein the signal outputted by said controller to said regeneration valve to allow fluid flow to the head end portion of the actuating cylinder will allow partial fluid flow thereto on a proportional basis when the velocity of said piston is between a third and fourth predetermined threshold velocity.

9. The fluid regeneration circuit as set forth in claim 7 including an operator input device actuatable to command a particular direction of movement of the actuating cylinder, said operator input device generating a signal indicative of the particular direction of movement of the actuating cylinder, said controller being coupled to said operator input device for receiving signals therefrom, said controller being operable to output a signal to said control valve to control the operation of the actuating cylinder when said controller receives a signal from said operator input device indicative of the particular direction of movement of the actuating cylinder being commanded by the operator.

10. The fluid regeneration circuit as set forth in claim 9 wherein said operator input device is an electronic joystick.

11. A fluid regeneration circuit for a hydraulic system having at least one hydraulic actuator mechanism associated therewith for controlling movement of a work element, said actuator mechanism having an expanding side, a contracting side, and a member moveable by the actuator mechanism, the regeneration circuit comprising:

a regeneration valve connected in fluid communication with the expanding and contracting sides of the actuator mechanism, said regeneration valve having an inlet port connected in fluid communication with the contracting side of the actuator mechanism via a first fluid path, said regeneration valve having a first outlet port connected in fluid communication with the hydraulic system via a second fluid path, said regeneration valve having a second outlet port connected in fluid communication with the expanding side of the actuator mechanism via a third fluid path;

a position sensor coupled to the actuator mechanism for determining the position of the movable member; and a controller coupled to said position sensor for receiving signals therefrom, said controller being operable to receive signals from said position sensor indicative of the position of the moveable member, said controller being further operable to determine the velocity of said moveable member based upon the signal outputted by said position sensor;

said controller being coupled to said regeneration valve and being operable to output signals thereto in response to the signals received from said position sensor, said controller outputting a signal to said regeneration valve to allow fluid flow from said regeneration valve through said third fluid path to the expanding side of the actuator mechanism when the velocity of the moveable member is determined to be above a first predetermined threshold velocity, said controller outputting a signal to the regeneration valve to allow fluid flow from said regeneration valve through said second fluid path when said controller determines that the velocity of the moveable member is below a second predetermined threshold velocity.

12. The fluid regeneration circuit as set forth in claim 11 wherein the actuator mechanism is a hydraulic actuating cylinder.

13. A fluid regeneration circuit for a hydraulic system having at least one hydraulic actuating cylinder associated therewith, said actuating cylinder having a head end portion, a rod end portion, and a piston movable therewithin, the regeneration circuit comprising:

a regeneration valve connected in fluid communication with the head and rod end portions of the actuating cylinder, said regeneration valve having an inlet port connected in fluid communication with the rod end portion of the actuating cylinder via a first fluid path, said regeneration valve having a first outlet port connected in fluid communication with the hydraulic system via a second fluid path, said regeneration valve having a second outlet port connected in fluid communication with the head end portion of the actuating cylinder via a third fluid path;

a first sensor coupled to the actuating cylinder adapted to sense a parameter indicative of a velocity of said piston, said sensor generating a first sensor signal; and a controller coupled to said first sensor for receiving signals therefrom, said controller being operable to receive signals from said first sensor indicative of the velocity of the piston within the actuating cylinder during movement thereof and responsively determining a cylinder velocity; said controller being coupled to said regeneration valve and being operable to output signals thereto in response to the signals received from said first sensor, said controller outputting a signal to said regeneration valve to allow fluid flow from said regeneration valve through said third fluid path to the head end portion of the actuating cylinder when the velocity of the piston is determined to be above a first predetermined threshold velocity.

14. A fluid regeneration circuit, as set forth in claim 13, further comprising:

an operator input device adapted to generate a control signal indicative of an operator desired command; and wherein said controller is further adapted to receive said control signal, said controller outputting a signal to said regeneration valve to allow fluid flow from said regeneration valve through said third fluid path to the head end portion of the actuating cylinder when the velocity of the piston is determined to be above a first predetermined threshold velocity and said operator desired command is above a first command threshold.

15. A fluid regeneration circuit for a hydraulic system, as set forth in claim 14, wherein said control signal is indicative of a position of said operator input device, and wherein said controller is adapted to determine a position of said operator input device in response to said control signal, and said controller outputting a signal to said regeneration valve to allow fluid flow from said regeneration valve through said third fluid path to the head end portion of the actuating cylinder when the velocity of the piston is determined to be above a first predetermined threshold velocity and said device position is above a first position threshold.

16. A fluid regeneration circuit for a hydraulic system, as set forth in claim 15, wherein said controller is further adapted to output a signal to the regeneration valve to allow fluid flow from said regeneration valve through said second fluid path when said controller determines that the velocity of the piston is below a second predetermined threshold velocity.

17. A fluid regeneration circuit for a hydraulic system, as set forth in claim 15, wherein said controller is further adapted to output a signal to the regeneration valve to allow fluid flow from said regeneration valve through said second fluid path when said controller determines said device position below a second position threshold.

18. A fluid regeneration circuit for a hydraulic system, as set forth in claim 15, wherein said controller is further adapted to output a signal to the regeneration valve to allow fluid flow from said regeneration valve through said second fluid path when said controller determines said device position below a second position threshold and said piston velocity is below a second predetermined threshold velocity.

19. A method of regenerating fluid in a hydraulic circuit, the circuit having at least one hydraulic actuating cylinder, the cylinder having a head end portion and a rod end portion, and a piston moveable therewithin, the circuit having a regeneration valve connected in fluid communication with the head end and rod end portions of the actuating cylinder, the regeneration valve having an inlet port connected in fluid communication with the rod end portion of the actuating cylinder via a first fluid path, said regeneration valve having a first outlet port connected in fluid communication with the hydraulic system via a second fluid path, said regeneration valve having a second outlet port connected in fluid communication with the head end portion of the actuating cylinder via a third fluid path, the hydraulic circuit including an operator input device connected to a controller, the controller being controllably connected to the regeneration valve, comprising the steps:

sensing a first parameter indicative of a piston velocity and responsively generating a first sensed signal;

sensing a second parameter indicative of an operator desired command and responsively generating a second sensed signal;

determining said piston velocity in response to said first signal;

determining said operator command in response to said second signal; and triggering said regeneration when said piston velocity is greater than a velocity threshold and said operator command is greater than a command threshold.

20. A method, as set forth in claim 19, wherein said first parameter is a piston position.

21. A method, as set forth in claim 19, wherein said first parameter is a piston velocity.

22. A method, as set forth in claim 19, wherein said second parameter is a position of said operator input device, and further wherein said command threshold includes an operator input device position threshold.

23. A method, as set forth in claim 19, wherein the step of triggering said regeneration includes the step of outputting a signal to said regeneration valve to allow fluid flow from said regeneration valve through said third fluid path to the head end portion of the actuating cylinder.

24. A method, as set forth in claim 23, further comprising the step of determining said piston velocity is below a second velocity threshold and responsively outputting a signal to the regeneration valve to allow fluid flow from said regeneration valve through said second fluid path.

25. A method, as set forth in claim 23, further comprising the step of determining said operator input device position is below a second position threshold and responsively outputting a signal to the regeneration valve to allow fluid flow from said regeneration valve through said second fluid path.

* * * * *